US008286280B1

(12) United States Patent
Matos

(10) Patent No.: US 8,286,280 B1
(45) Date of Patent: Oct. 16, 2012

(54) BOXING RING BED DEVICE

(76) Inventor: Manuel Matos, Malden, MA (US)

( * ) Notice: Subject to any disclaimer, the term of this patent is extended or adjusted under 35 U.S.C. 154(b) by 0 days.

(21) Appl. No.: 13/086,910

(22) Filed: Apr. 14, 2011

(51) Int. Cl.
*A47D 11/00* (2006.01)

(52) U.S. Cl. ..... 5/2.1; 5/400

(58) Field of Classification Search ..... 5/2.1, 93.1, 5/420, 425, 400
See application file for complete search history.

(56) References Cited

U.S. PATENT DOCUMENTS 1,753,328 A 4/1930 Barnes
1,991,848 A * 2/1935 Embree ..... 5/1
2,243,943 A 6/1941 Bunting
2,726,866 A 12/1955 Nally
3,755,820 A * 9/1973 Petrusek ..... 2/18
D252,598 S 8/1979 Carter
D252,599 S 8/1979 Carter
5,182,824 A * 2/1993 Cipriano ..... 5/2.1
D411,696 S 6/1999 Sorrell
6,340,334 B1 * 1/2002 Olsen et al. ..... 472/93
D471,375 S 3/2003 Nichols, III et al.
6,578,214 B2 * 6/2003 Peftoulidis ..... 5/308

* cited by examiner

*Primary Examiner* — Fredrick Conley

(57) ABSTRACT

A boxing ring bed device for use as a bed, a boxing ring, and a wrestling ring comprising a base designed to rest on the floor and function as a platform for a futon, support posts disposed in the corners of the base, and perimeter ropes that form a ring around the base.

6 Claims, 5 Drawing Sheets

BOXING RING BED DEVICE

FIELD OF THE INVENTION

The present invention is directed to a bed or other furnishing for sleeping. More particularly, the present invention is directed to a bed that also serves as a boxing ring or a wrestling ring.

BACKGROUND OF THE INVENTION

The present invention features a boxing ring bed device for use as a bed, a boxing ring, and a wrestling ring. The boxing ring bed device of the present invention comprises a base designed to rest on the floor and function as a platform for a futon. Disposed in the corners of the base are support poles which are similar to ring posts seen in a boxing ring. Attached to the support poles is a perimeter rope to form a ring.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
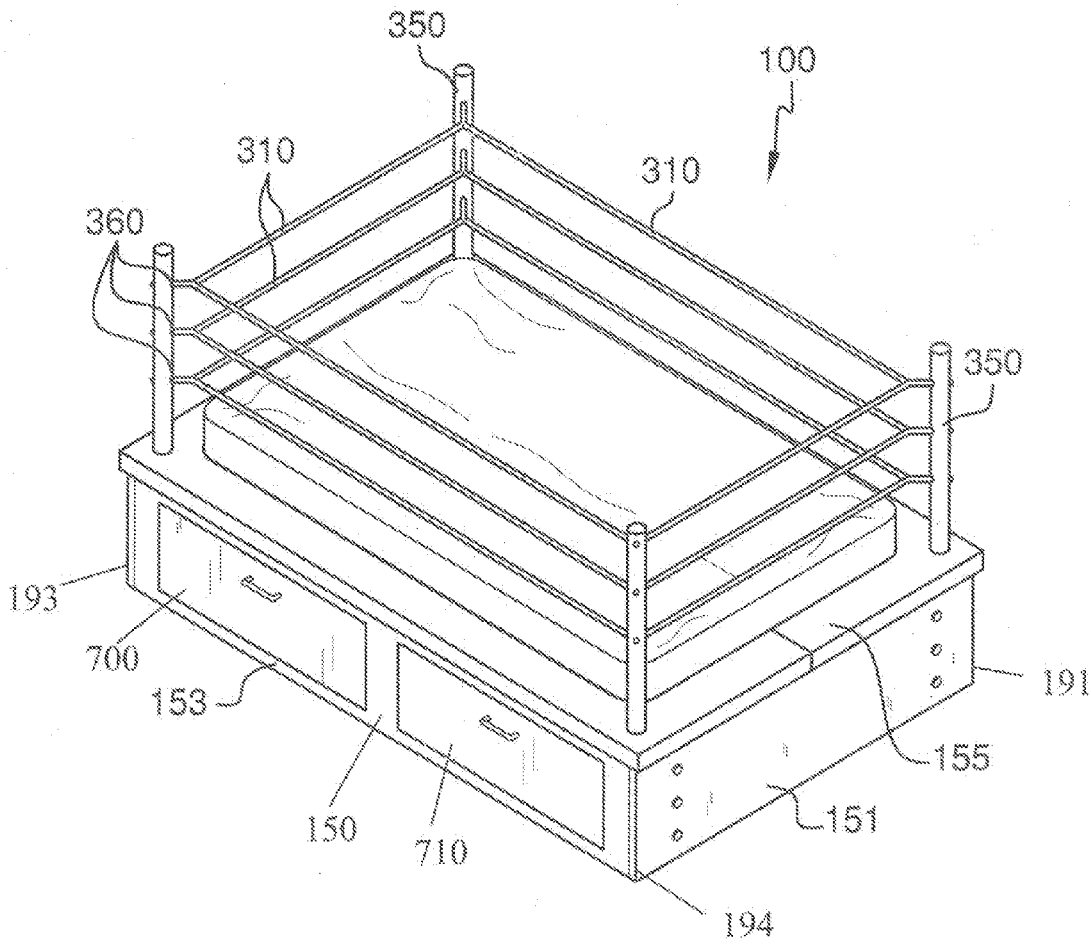
FIG. 1 is a perspective view of the boxing ring bed device of the present invention.
Figure 2:
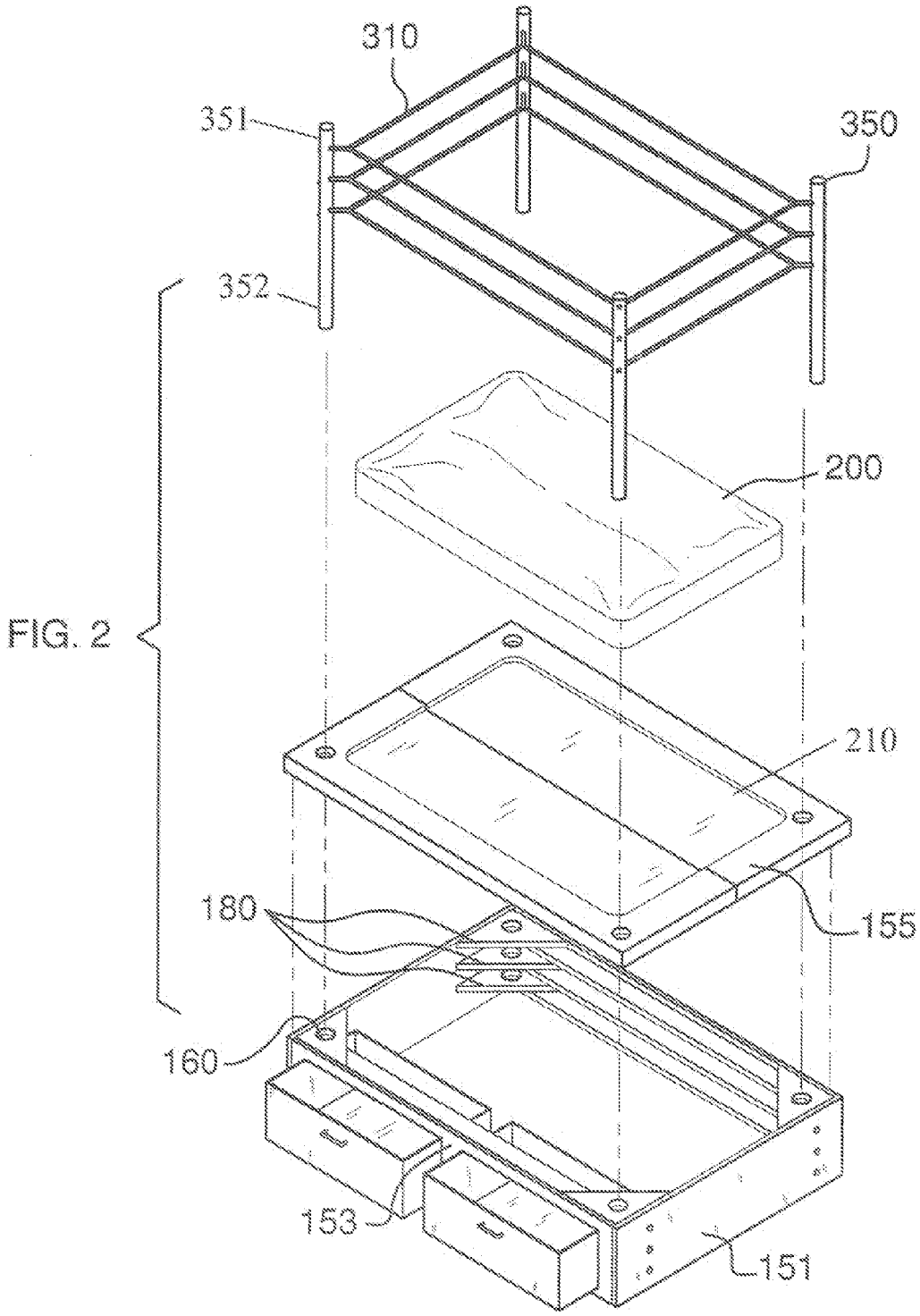
FIG. 2 is an exploded perspective view of the components of the boxing ring bed device of the present invention.

The following is a listing of numbers corresponding to a particular element refer to herein:

| | |
|---|---|
| 100 | boxing ring bed device |
| 150 | base |
| 151 | first side of base |
| 152 | second side of base |
| 153 | third side of base |
| 154 | fourth side of base |
| 155 | top surface of base |
| 156 | bottom surface of base |
| 160 | pole aperture |
| 180 | reinforcement supports |
| 191 | first corner of base |
| 192 | second corner of base |
| 193 | third corner of base |
| 194 | fourth corner of base |
| 200 | futon |
| 210 | indentation for futon |
| 310 | perimeter rope |
| 350 | support pole |
| 351 | first end of support pole |

-continued

| | |
|---|---|
| 352 | second end of support pole |
| 360 | rope fastener |
| 380 | foam cushion |
| 450 | middle stress bar |
| 451 | first end of middle stress bar |
| 452 | second end of middle stress bar |
| 460 | stress bar support beam |
| 465 | slot |
| 600 | pillow |
| 700 | first drawer |
| 710 | second drawer |

Referring now to FIGS. 1-7, the present invention features a boxing ring bed device 100 for use as a bed, a boxing ring, and a wrestling ring. The boxing ring bed device 100 of the present invention comprises a generally rectangular and hollow base 150 having a first side 151, a second side 152, a third side 153, a fourth side 154, and a bottom surface 156. The third side of the base having a first drawer 700 and a second drawer 710 for storing items such as clothing or toys. The drawer on the third side may be similarly constructed (or alternatively constructed) on the first side. A first half platform 156 and second half platform 157 combine to form a removable top surface 155 of the base 150. The base 150 is designed to rest on the floor. A futon 200 can be placed atop the top surface 155 of the base 150. In some embodiments, the base 150 has a first corner 191 (e.g., the intersection between the first side 111 and the third side 113), a second corner 192 (e.g., the intersection between the first side 111 and the fourth side 114), a third corner 193 (e.g., the intersection between the second side 112 and the third side 113), and a fourth corner 194 (e.g., the intersection between the second side 112 and the fourth side 114).

In some embodiments, a reinforcement support 180 is disposed in the first corner 191 and/or second corner 192 and/or third corner 193 and/or fourth corner 194. In some embodiments, two reinforcement supports 180 are disposed in the first corner 191 and/or second corner 192 and/or third corner 193 and/or fourth corner 194. In some embodiments, three reinforcement supports 180 are disposed in the first corner 191 and/or second corner 192 and/or third corner 193 and/or fourth corner 194. In some embodiments, more than three reinforcement supports 180 are disposed in the first corner 191 and/or second corner 192 and/or third corner 193 and/or fourth corner 194. In some embodiments, the reinforcement supports 180 are spaced a certain distance apart in between the top surface 155 of the base 150 and the bottom surface 156 of the base 160 (see FIG. 4). By the earlier definition of the four corners, the reinforcement supports are attached to two adjacent sides of the base as follows: Each reinforcement support 180 which is disposed in the first corner 191 is attached to the first side 111 and the third side 113 of the base. Each reinforcement support 180 which is disposed in the second corner 192 is attached to the first side 111 and the fourth side 114 of the base. Each reinforcement support 180 which is disposed in the third corner 193 is attached to the second side 112 and the third side 113 of the base. Each reinforcement support 180 which is disposed in the fourth corner 194 is attached to the second side 112 and the fourth side 114 of the base.

Disposed in the reinforcement support 180 is a pole aperture 160 for receiving a support pole 350. The support poles 350 are similar to ring posts seen in a boxing ring, well known to one of ordinary skill in the art. In some embodiments, a pole aperture 160 is disposed in the top surface 155 of the base 150 at the first corner 191 and/or the second corner 192 and/or the third corner 193 and/or the fourth corner 194. A user can insert a support pole 350 through the pole aperture 160 in the top surface 155 of the base 150 at a particular corner, and further through the pole apertures 160 in one or more reinforcement supports 180 in that particular corner of the base 150 (see FIG. 2).

In some embodiments, a first support pole is located at the first corner 191 of the base, a second support pole is located at the second corner 192 of the base 150, a third support pole is located at the third corner 193 of the base 150, a fourth support pole is located at the fourth corner 194 of the base 150. Each of the support poles 350 have a first end 351, a second end 352. In some embodiments, one or more (e.g., three) rope fasteners 360 are disposed along the support poles 350, for example near the first end 351. The rope fasteners 360 are for attaching a perimeter rope 310. The perimeter rope 310 connects to rope fasteners 360 of the first support post, the second support post, the third support post, and the fourth support post, forming a ring similar to a boxing ring, well known to one of ordinary skill in the art (see FIG. 1). In some embodiments, the perimeter ropes 310 are covered with a soft or padded fabric.

The top surface 155 of the base 150 has an outer perimeter, for example the futon 200 does not cover the entire top surface 155. A user can stand on the outer perimeter of the top surface 155 of the base 150. In some embodiments, an indentation 210 is disposed in the top surface 155 of the base 150, wherein the indentation 210 is for holding the futon 200.

Figure 3:
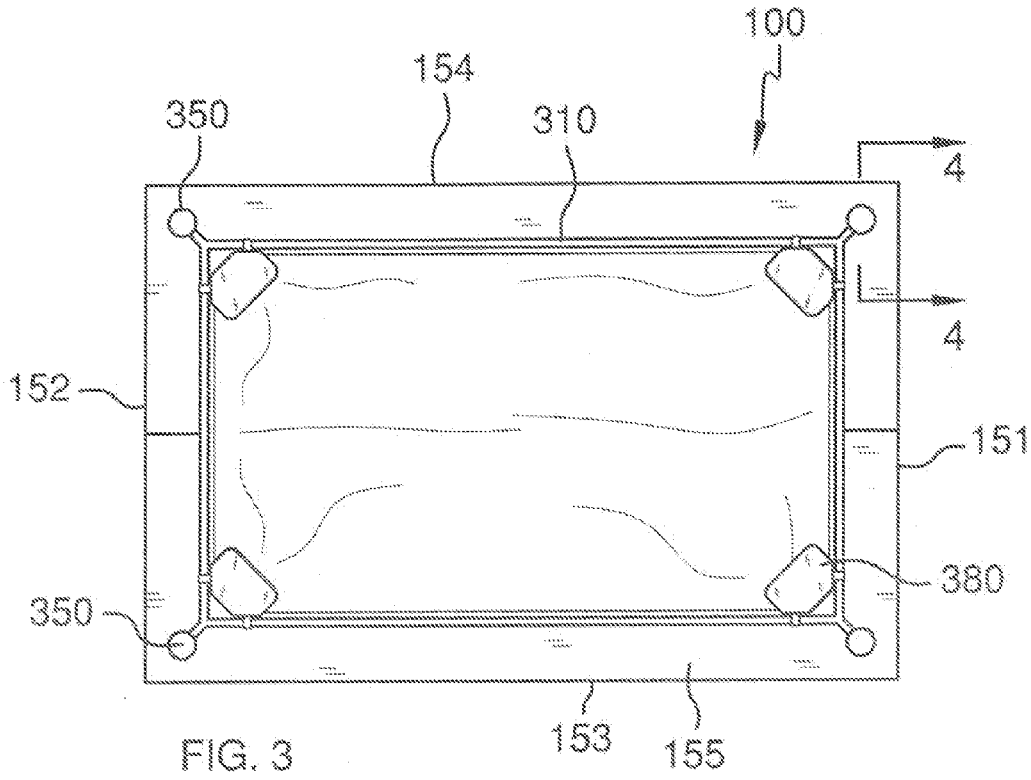
FIG. 3 is a top view of the boxing ring bed device of the present invention.
Figure 4:
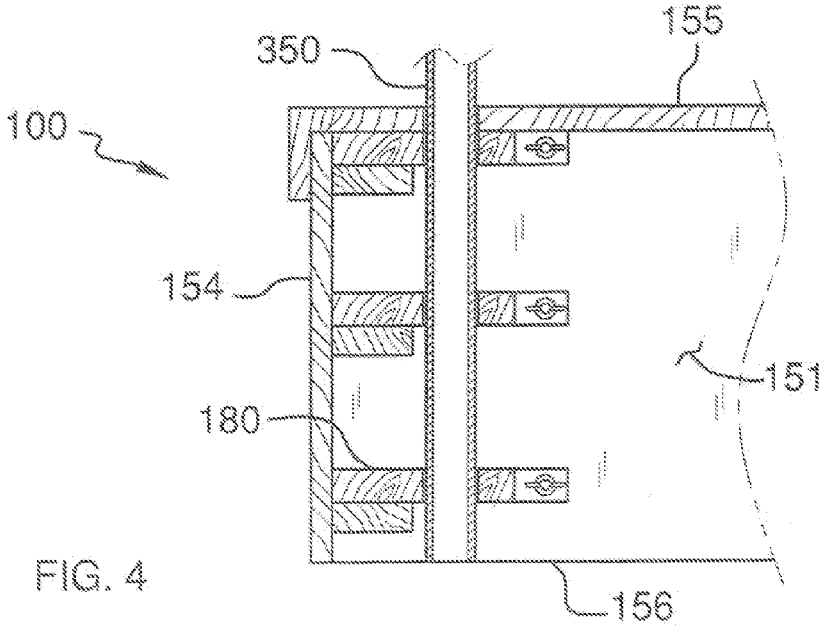
FIG. 4 is a side view and cross sectional view of the boxing ring bed device of the present invention.
Figure 5:
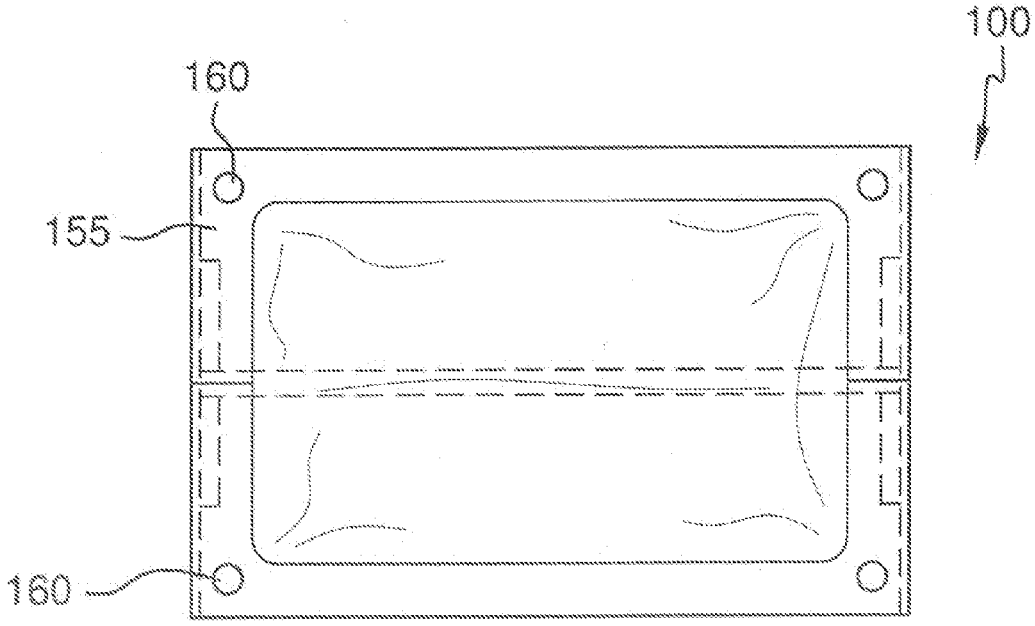
FIG. 5 is a top and internal view of a boxing ring bed device of the present invention.
Figure 7:
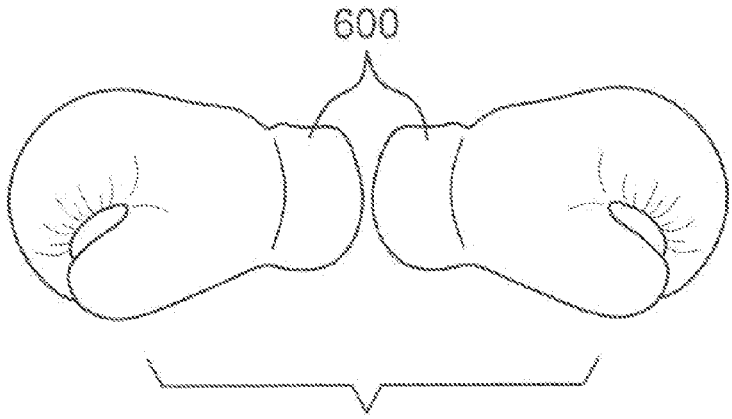
FIG. 7 is a top exploded view of a boxing ring bed device of the present invention.
Figure 6:
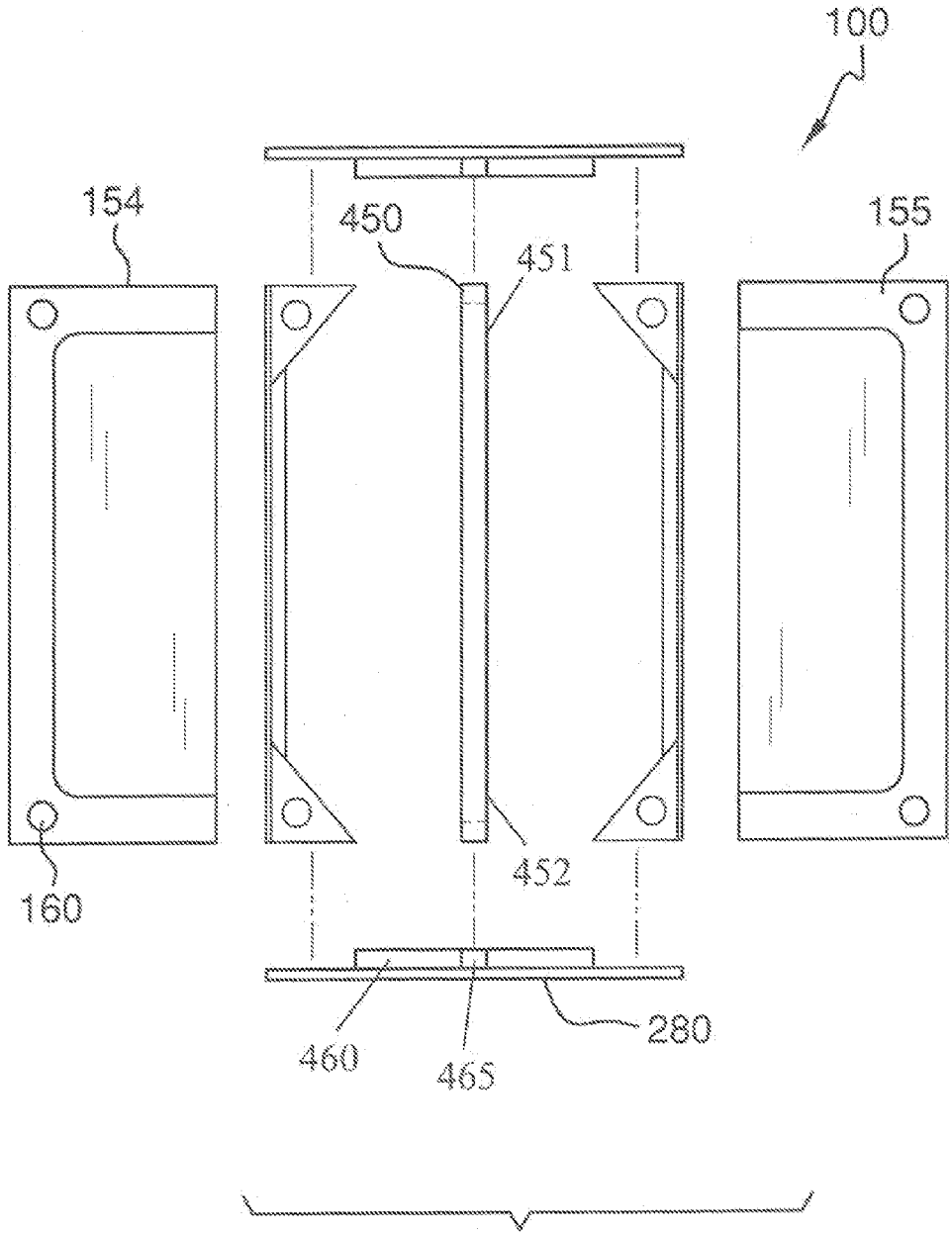
FIG. 6 is a front view of a pillow of the present invention.

In some embodiments, the boxing ring bed device 100 further comprises one or more foam cushions 380 for attaching to the support posts 350 (see FIG. 3). In some embodiments, one or more padded guards are secured over the rope fasteners 360 disposed on the support posts 350. The foam cushions 380 and the padded guards are for providing safety to the user so he/she does not hurt him/herself when contacting the support posts 350 or the rope fasteners 360.

In some embodiments, the boxing bed device 100 further comprises one or more accessories. For example, in some embodiments, the boxing bed device 100 further comprises one or more pillows 600 shaped and colored like a boxing glove (see FIG. 7). In some embodiments, the boxing bed device 100 further comprises a laundry bag shaped and colored like a standard boxing punching bag.

In some embodiments, the boxing bed device 100 of the present invention further comprises a middle stress bar 450 that runs the length of the base 150, for example from the first side 151 to the second side 152. The middle stress bar 450 may provide additional support for the futon 200 that lies atop the top surface 155 of the base 150.

In some embodiments, the middle stress bar 450 has a first end 451 and a second end 452, wherein the first end 451 is attached to the first end 151 of the base 150 and the second end 452 is attached to the second end 152 of the base 150. In some embodiments, a slot 465 for receiving the first end 451 or second end 452 of the middle stress bar 450 is disposed in the first end 151 and second end 152 of the base 150, respectively. In some embodiments, a stress bar support beam 460 is disposed on the first end 151 of the base 150 and/or the second end 152 of the base 150. In some embodiments, a slot 465 for receiving the middle stress bar 450 is disposed in the stress bar support beam 460. The middle stress bar 450 is flush with the top surface 155 of the base 150.

The boxing ring bed device 100 may be constructed in a variety of shapes, sizes, and/or colors. For example, in some embodiments, the boxing ring bed device 100 is constructed in a rectangular shape, a round shape, an octagon shape, the like, or a combination thereof.

In some embodiments, the base 150 is colored black. In some embodiments, the foam cushions 380 and/or pillow 600 is colored red. In some embodiments, the rope 310 is colored red, white, and/or black.

The boxing ring bed device 100 of the present invention may be constructed from a variety of materials. For example, in some embodiments, the boxing ring bed device 100 is constructed from a material comprising a wood, a plastic, a fabric, a rubber, a metal (e.g., aluminum), the like, or a combination thereof.

As used herein, the term "about" refers to plus or minus 10% of the referenced number. For example, an embodiment wherein the base is about 10 inches in height includes a base that is between 9 and 11 inches in height.

In some embodiments, the base 150 is between about 4 to 8 inches in height as measured from the top surface 155 to the bottom surface 156. In some embodiments, the base 150 is between about 8 to 12 inches in height as measured from the top surface 155 to the bottom surface 156. In some embodiments, the base 150 is between about 12 to 18 inches in height as measured from the top surface 155 to the bottom surface 156.

In some embodiments, the base 150 is between about 4 to 5 feet in length as measured from the first corner 191 to the third-corner 193. In some embodiments, the base 150 is between about 5 to 7 feet in length as measured from the first corner 191 to the third corner 193. In some embodiments, the base 150 is between about 7 to 10 feet in length as measured from the first corner 191 to the third corner 193. In some embodiments, the base 150 is more than about 0 feet in length as measured from the first corner 191 to the third corner 193.

In some embodiments, the base 150 is between about 3 to 4 feet in width as measured from the first corner 191 to the second corner 192. In some embodiments, the base 150 is between about 4 to 5 feet in width as measured from the first corner 191 to the second corner 192. In some embodiments, the base 150 is more than about 5 feet in width.

The following the disclosures of the following U.S. Patents are incorporated in their entirety by reference herein: U.S. Pat. No. 2,726,866; U.S. Pat. No. 2,243,943; U.S. Pat. No. 5,182,824; U.S. Pat. No. 1,753,328; U.S. Pat. No. 6,578,214 B2.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

Optional accessories would be available to go with this device such as an extension or arm which can hold a flatscreen tv as well as a video game which could be inserted onto any of the ring posts. Additional accessories could be a locker, a stool, a set of steps to step into the ring and wallpaper of a crowd that would surround the entire bedroom, thus enhancing the boxing or wrestling theme.

What is claimed is:

1. A boxing ring bed device for use as a bed or a boxing ring, said boxing ring bed device comprising:

(a) a generally rectangular and hollow base having a first side, a second side, a third side, a fourth side, and a bottom surface;

(b) the third side of the base having a first drawer and a second drawer;

(c) a first half platform and a second half platform that combine to form a removable top surface of the base;

(d) a futon for placing atop the top surface of the base;

(e) a reinforcement support disposed in each of a first corner of the base, a second corner of the base, a third corner of the base, and a fourth corner of the base; wherein each reinforcement support comprises a pole aperture for receiving a support pole and each reinforcement support is attached to two adjacent sides of the base; and (f) a rope fastener disposed on each of the support poles, wherein the rope fasteners are for attaching a perimeter rope that forms a ring around the futon.

2. The boxing ring bed device of claim 1 further comprising a middle stress bar having a first end and a second end, wherein the first end of the middle stress bar is attached to the first end of the base and the second end of the middle stress bar is attached to the second end of the base, wherein the middle stress bar can provide support for the futon.

3. The boxing ring bed device of claim 2, wherein the middle stress bar is flush with the top surface of the base.

4. The boxing ring bed device of claim 1 further comprising one or more foam cushions for attaching to the support posts.

5. The boxing ring bed device of claim 1 further comprising one or more pillows shaped like a boxing glove.

6. The boxing ring bed device of claim 1 further comprising a laundry bag shaped like a punching bag.

* * * * *